US009556691B2

(12) United States Patent
Van Zee et al.

(10) Patent No.: US 9,556,691 B2
(45) Date of Patent: Jan. 31, 2017

(54) HORIZONTAL DIRECTIONAL DRILLING SYSTEM

(71) Applicant: VERMEER MANUFACTURING COMPANY, Pella, IA (US)

(72) Inventors: Michael D. Van Zee, Pella, IA (US); Clint M. Recker, Pella, IA (US)

(73) Assignee: Vermeer Manufacturing Company, Pella, IA (US)

( * ) Notice: Subject to any disclaimer, the term of this patent is extended or adjusted under 35 U.S.C. 154(b) by 229 days.

(21) Appl. No.: 14/349,173

(22) PCT Filed: Oct. 3, 2012

(86) PCT No.: PCT/US2012/000468
§ 371 (c)(1),
(2) Date: Apr. 2, 2014

(87) PCT Pub. No.: WO2013/055389
PCT Pub. Date: Apr. 18, 2013

(65) Prior Publication Data

US 2014/0284111 A1 Sep. 25, 2014

Related U.S. Application Data

(60) Provisional application No. 61/542,577, filed on Oct. 3, 2011.

(51) Int. Cl.
*E21B 21/12* (2006.01)
*E21B 7/20* (2006.01)
(Continued)

(52) U.S. Cl.
CPC ..... *E21B 21/12* (2013.01); *E21B 3/02* (2013.01); *E21B 4/20* (2013.01); *E21B 7/02* (2013.01);
(Continued)

(58) Field of Classification Search
CPC ..... E21B 7/02; E21B 7/046; E21B 7/20; E21B 15/04; E21B 15/045; E21B 17/18; E21B 21/12
See application file for complete search history.

(56) References Cited

U.S. PATENT DOCUMENTS 4,387,775 A * 6/1983 Adolfsson ..... B25D 17/084 173/131
5,195,754 A 3/1993 Dietle
(Continued)

FOREIGN PATENT DOCUMENTS

DE 10 2008 003 968 B3 12/2009
WO WO 2010/101987 A2 9/2010
WO WO2011/146490 * 11/2011 ..... E21B 10/08

OTHER PUBLICATIONS

International Search Report for corresponding International Patent Application No. PCT/US2012/000468 mailed Feb. 19, 2013.

*Primary Examiner* — David Andrews
*Assistant Examiner* — Tara Schimpf
(74) *Attorney, Agent, or Firm* — Merchant & Gould P.C.

(57) ABSTRACT

The present disclosure provides a drilling machine configuration and related method that avoids drilling mud from contaminating hydraulic fluid that flows through the drive system of the machine. The disclosed system and method provides a drilling mud anti-contamination system that requires infrequent service and a system wherein the service can be quickly and easily performed.

13 Claims, 10 Drawing Sheets

(51) Int. Cl.

| | |
|---|---|
| ***E21B 15/04*** | (2006.01) |
| ***E21B 7/02*** | (2006.01) |
| ***E21B 17/18*** | (2006.01) |
| ***E21B 4/20*** | (2006.01) |
| ***E21B 3/02*** | (2006.01) |
| ***E21B 7/04*** | (2006.01) |
| ***E21B 21/02*** | (2006.01) |

(52) U.S. Cl.
CPC ..... *E21B 7/046* (2013.01); *E21B 7/20* (2013.01); *E21B 15/04* (2013.01); *E21B 15/045* (2013.01); *E21B 17/18* (2013.01); *E21B 21/02* (2013.01)

(56) References Cited

U.S. PATENT DOCUMENTS

| | | | |
|---|---|---|---|
| 5,679,894 | A | 10/1997 | Kruger et al. |
| 6,382,634 | B1 | 5/2002 | Dietle et al. |
| 2004/0256160 | A1 | 12/2004 | Fonseca |
| 2009/0095527 | A1 | 4/2009 | Lane et al. |
| 2011/0127725 | A1 | 6/2011 | Dietle |

* cited by examiner

HORIZONTAL DIRECTIONAL DRILLING SYSTEM

This application is a National Stage Application of PCT/US2012/000468, filed Oct. 3, 2012, which claims benefit of U.S. Provisional Patent Application No. 61/542,577, filed Oct. 3, 2011 and which applications are incorporated herein by reference. To the extent appropriate, a claim of priority is made to each of the above-disclosed applications.

TECHNICAL FIELD

The present disclosure provides an apparatus and method for directional drilling.

BACKGROUND

Directional boring machines and methods for making underground holes are known. A typical directional boring machine is generally configured to drive into the ground a series of drill rods joined end-to-end to form a drill string. At the end of the drill string is a rotating drilling tool. Typically, the rotation of the drill tool is driven by a mud motor or by axially rotating the drill string itself. Various techniques and configurations can be used to provide steering of the drill string during boring operations. Improvements in directional boring machines, drill strings for use with such machines, and methods of directional drilling are needed.

SUMMARY

The present disclosure provides a drilling machine configuration and related method that avoids drilling mud from contaminating hydraulic fluid that flows through the drive system of the machine. The disclosed system and method provides a drilling mud anti-contamination system that requires infrequent service and a system wherein the service can be quickly and easily performed.

DETAILED DESCRIPTION

Figure 4:
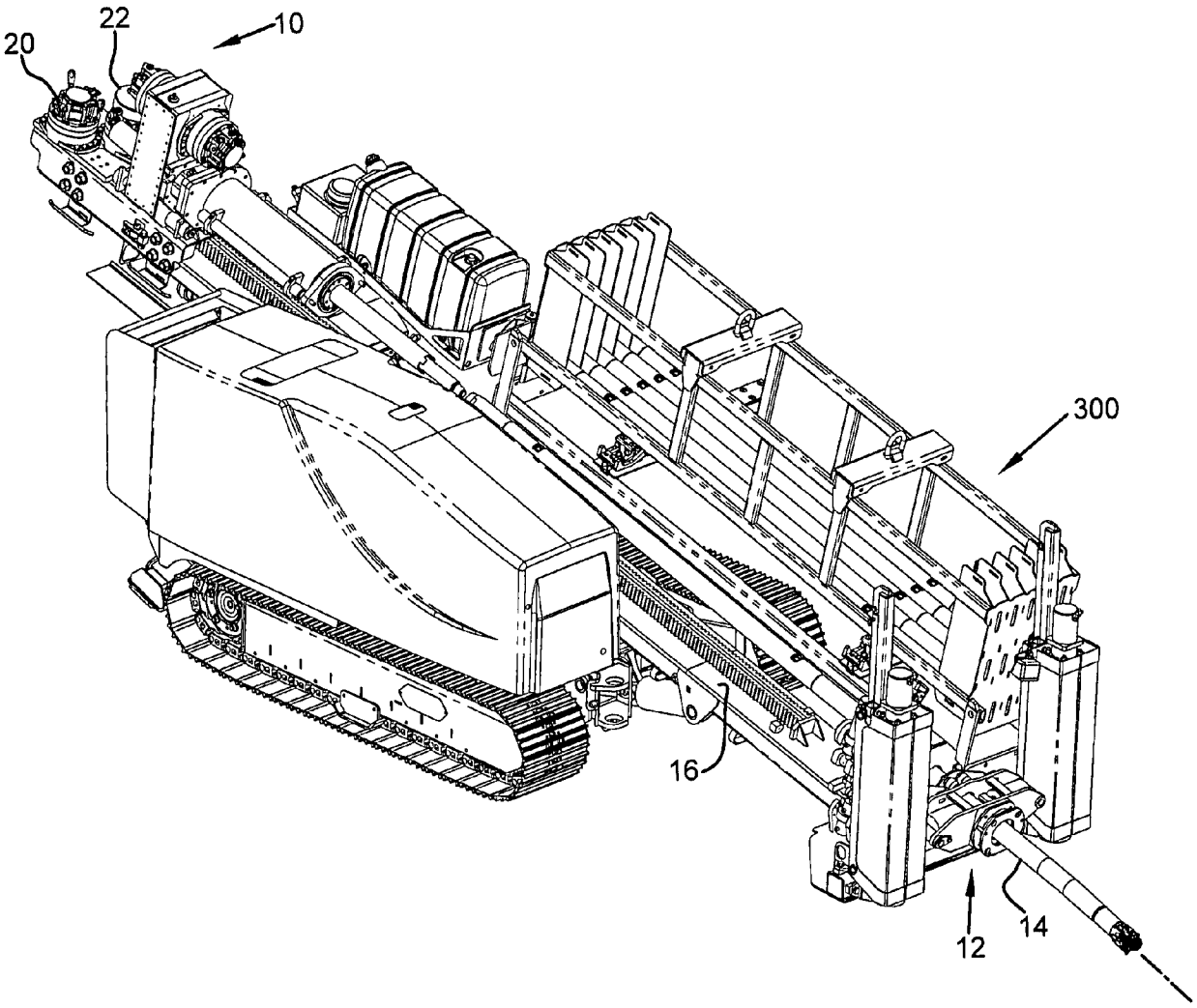
FIG. 4 illustrates a drilling machine that embodies the features of the present disclosure.

A machine which can utilize various aspects of the present invention can be, for example, a machine shown in FIG. 4 that is primarily used for horizontal surface boring, wherein the bore will enter the ground at an angle typically between 10 degrees and 30 degrees, as measured from the horizontal.

However, it should be appreciated that the current invention is not limited to this configuration, and could be applied to drill machines configured for vertical boring, which typically include the same basic machine elements.

The basic elements of the drilling machine include a chassis which in some embodiments is movably supported on wheels or tracks. The chassis supports a drill string drive assembly 10 and a break out mechanism 12.

The drill string drive assembly 10 is configured to rotate the drill string 14 about a drill axis, and to push and pull drill string 14 by moving longitudinally along the rack 16. The drill string 14 is comprised of any number of individual drill rods that have been connected end-to-end. The angle of the drill string drive assembly 10 relative to the ground surface can be adjusted via controlling a tilt mechanism (e.g., hydraulic cylinder). In other words, the tilt control mechanism can be used to control the vertical orientation of the drill string 14 as it is introduced into the ground. The drill rod loading assembly 300 is configured to transport drill rods between the drill string drive assembly and the drill rod storage unit.

In the depicted embodiment, the drill string drive unit 10 is configured to be driven towards the break out mechanism 12 to push a section of the drill string 14 into the ground, and be driven away from the break out mechanism 12 to pull a section of the drill string 14 from the ground. During the pushing and the pulling, the drive unit 10 can also rotate the drill string 14 about its longitudinal axis. In the depicted embodiment, the drill string drive assembly 10 includes a carriage 18 that engages the rack 16. The carriage 18 supports the drive unit 10 and moves the drive unit 10 in an axial direction relative to the frame 18. In the depicted embodiment the carriage 18 includes two hydraulic motors 20, 22 that drive the movement of the carriage 18 along the rack 16.

The break out mechanism 12 is configured to hold the drill string 14 in place while sections of the drill string (drill rods) are added or removed. In the drill rod adding process, the break out mechanism 12 secures the upper end of the drill string 14 while the drill rod loading assembly aligns the drill rod that is to be added to the drill string 14 with the upper end of the drill string 14 and drive unit 10. For machines without rod loading mechanisms, the drill rod is held in alignment in an alternate method. Once the lower end of the newly added rod is secured to the upper end of the drill string, the break out mechanism 12 releases the drill string 14, allowing the drive unit 10 to rotate and push the drill string 14 further into the ground.

In the drill rod removal process, the break out mechanism 12 secures the upper end of the drill string 14 while the drill rod that is to be removed is broken free from the drill string 14 and transported out of alignment from the drill string 14 by the drill rod loading assembly. For machines without rod loading mechanisms, the drill rod is held in alignment in an alternate method. Once the rod is removed, the drive unit 10 moves down to the upper end of the drill string 14 and is connected thereto. The break out mechanism 12 then releases the end of the drill string 14, allowing the drive unit to rotate and pull the drill string 14 further out of the ground.

The present disclosure incorporates features of a drilling machine that are particularly beneficial for drilling systems wherein the drill string is a dual tube, pipe or rod configuration, wherein there is an outer member, and an inner member. The outer member is referred to as a casing or the outer rod or outer pipe, while the inner member is referred to as an inner rod or inner pipe. In this document the drilling system will be referred to as a dual rod system. However, it should be appreciated that features of the present disclosure can be used with single rod machines as well.

Figure 1:
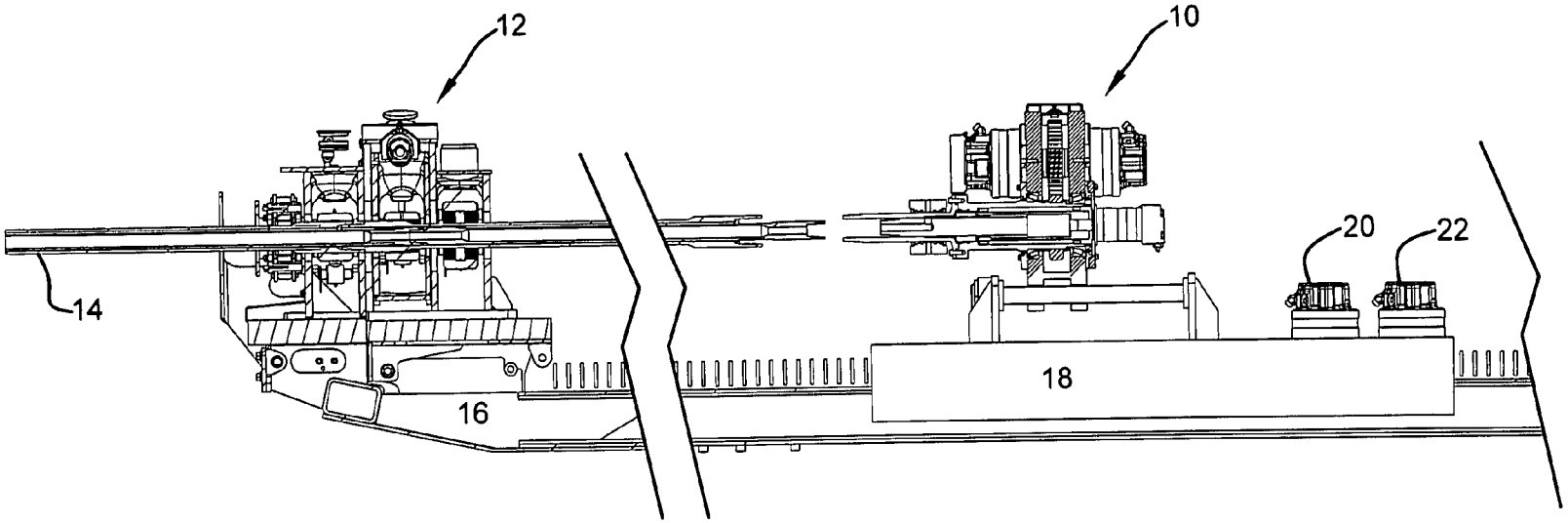
FIG. 1 is a cross-sectional view of a portion of the drilling machine according to the present disclosure.
Figure 2:
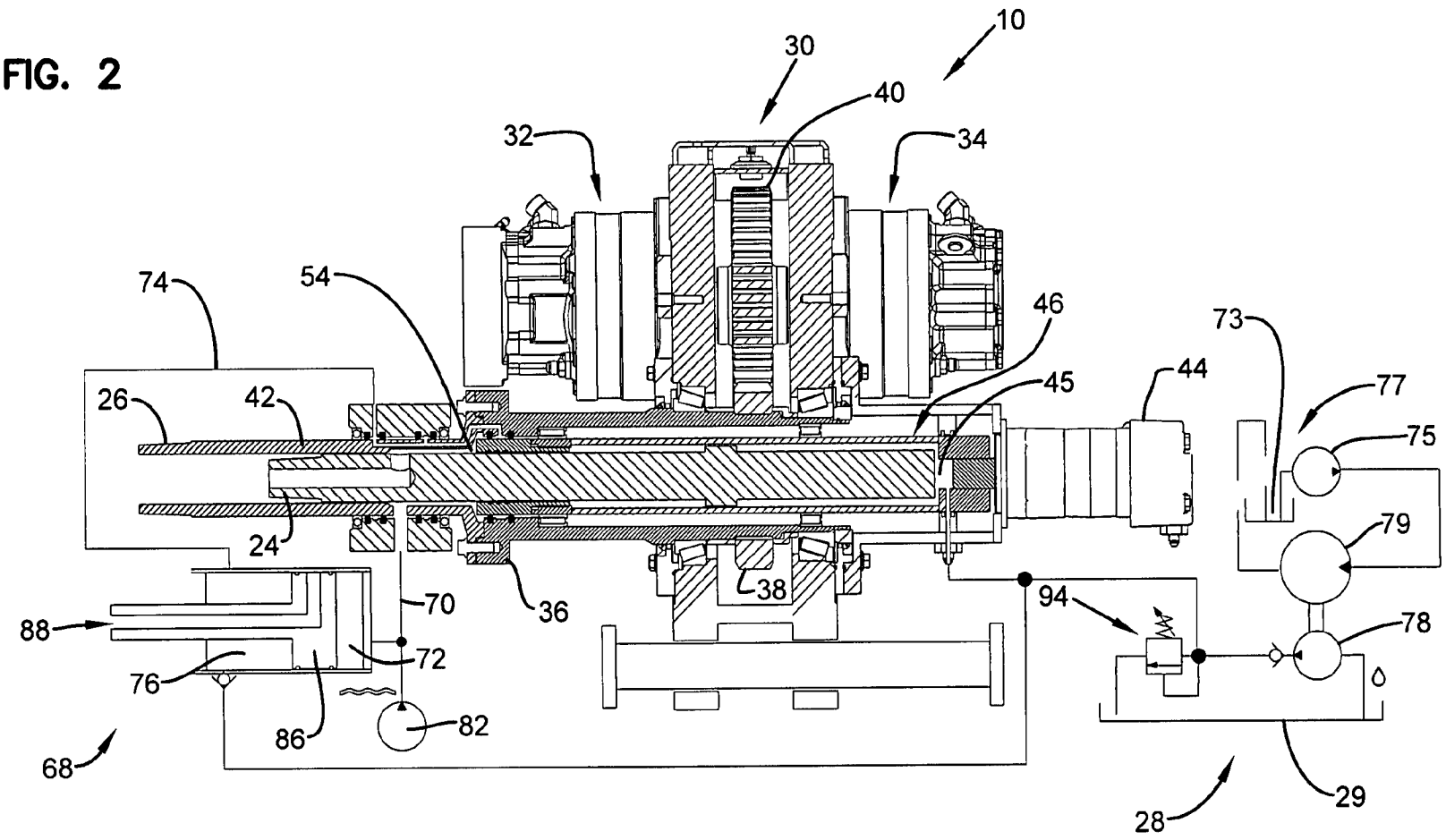
FIG. 2 is an enlarged view of the drive assembly of the drilling machine of FIG. 1 with schematic illustrations of a hydraulic circuit and drilling mud.

Referring to FIG. 2, the drill rod drive unit 10 of the present invention includes both an inner rod drive assembly with an inner rod drive spindle 24 (inner rod drive shaft) for rotating inner rods of a dual rod drill string, and an outer rod drive assembly with an outer rod drive spindle 26 (outer rod drive shaft) for rotating outer rods of a dual rod drill string. The rod drive unit 10 further includes a compensator assembly 28 for extending the inner rod drive spindle relative to the outer rod drive spindle a distance adequate to assure proper operation of the overall system, as will be explained in more detail below.

The drive unit 10 includes an outer rod driver gearbox 30 that supports two hydraulic motors 32 and 34, outer rod drive shaft 26, outer rod head shaft 36 and a set of gears 38 and 40. These components are configured to provide rotational drive torque to the outer rod drive spindle 26 through an arrangement that includes the head shaft 36 that is connected to an adapter 42 and includes the outer rod drive spindle 26 that is configured to thread onto the end of an outer member of a drill rod of a drill string.

Figure 3:
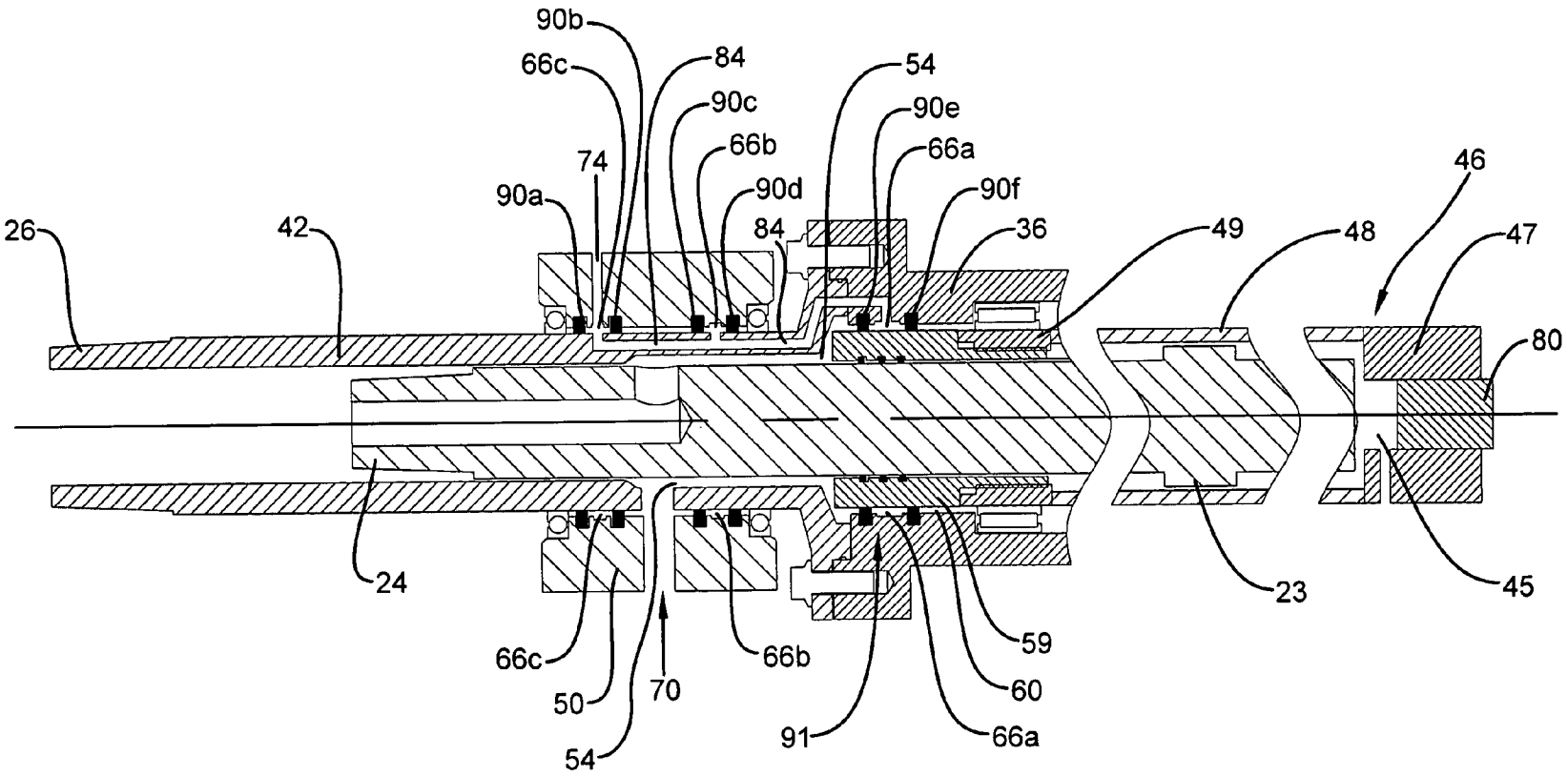
FIG. 3 is an enlarged view of a portion of FIG. 2.

The drill rod drive unit 10 further includes an inner rod driver motor 44 coupled to inner head shaft 46 that is coupled to the inner drive shaft 24 in a manner that inner drive shaft 24 can slide using components as illustrated in more detail in FIG. 3. The inner head shaft includes an inner drive tube 48 that has a non-circular inner profile that cooperates with a non-circular portion 23 of the inner drive shaft 24. This configuration allows the inner drive tube 25 to provide rotational drive torque to the inner drive shaft, while at the same time allowing the inner drive shaft to slide in a longitudinal direction. In the depicted embodiment the inner head shaft 46 is constructed from three separate components that are welded together. Drive sleeve 47 is welded to the inner drive tube 48 on one end. The drive sleeve 47 includes a drive coupling configured to mate with the drive shaft 80 of inner rod driver motor 44. Seal adaptor sleeve 49, welded to the inner drive tube 48 on the opposite end, includes a threaded inner diameter configured to mate with a replaceable seal adaptor 59. With this configuration the inner drive shaft 24 can slide in a longitudinal direction relative to the outer drive shaft 26. In the depicted embodiment the inner drive shaft 24 is housed partially within the head shaft 36, which is configured to rotate. Drilling mud is supplied to the drill string via the drilling mud delivery interface 50, which is mounted to the down hole end of the outer shaft 26.

Is should be appreciated that sealing the drilling mud to prevent contamination of the drilling machine components is challenging, and is particularly challenging for a dual rod system as described above wherein an inner drive shaft moves longitudinally relative to an outer drive shaft. The seals that are in contact with the abrasive drilling mud will be subjected to significant wear. The present invention incorporates several related aspects of the mechanical configuration which have been found to reduce the rate of seal wear, to extend the expected service life of the seals, to provide a convenient method for replacing the seals, and to minimize the impact of failed seals.

FIG. 3 illustrates the location of the primary seal system 91 where pressurized drilling mud is expected to be in cavity 54 and oil is expected to be in cavity 60.

Referring to FIG. 2, a hydraulic circuit 28, used for affecting the longitudinal movement of the inner drive shaft, is shown. In the depicted embodiment, this circuit includes a hydraulic motor 79 that is mechanically coupled to a hydraulic pump 78. The hydraulic motor 79 is in fluid coupling with a hydraulic circuit 77 of the rest of the machine, including a pump 75 and fluid reservoir 73, while the hydraulic pump 78 is in fluid coupling only with the gearbox, due to the fact that reservoir 29 is the gearbox itself.

During both the drill rod adding process and the drill rod removal process, the inner rod drive shaft 24 is moved longitudinally relative to the outer rod drive shaft, to expose the joint between the individual sections of the inner rod. This movement occurs when the motor 79 is caused to rotate, by the hydraulic circuit 77 of the main machine. This control can be accomplished in a number of ways, in the depicted embodiment a directional control valve (not shown) directs oil from pump 75 to motor 79. When motor 79 is caused to rotate, it will power hydraulic pump 78 which will draw oil from the gearbox or sump 29, directing it to cavity 45 on the inside of the inner head shaft 46, causing the inner rod drive shaft 24 to move longitudinally. This hydraulic circuit is configured to prevent widespread contamination of the hydraulic system of the drilling machine, that could result if mud in cavity 54 leaked past the primary seal system 91 and into cavity 60. Contamination of the hydraulic system of the drilling machine is avoided by the utilization of separate hydraulic reservoirs, and by the mechanical drive connection between the motor 79 and the pump 78. In other words, the power is transferred with a mechanical drive connection, wherein there is no transfer of fluid from hydraulic circuit 28 to the hydraulic circuit 77 of the rest of the machine.

In addition to creating the pressure to extend the inner drive shaft, hydraulic circuit 28 also provides oil to ensure consistent charging of a pressure intensifier assembly 68. This system is designed to provide a source of pressurized oil routed to a cavity adjacent each seal that is both in fluid contact with drilling mud and that can experience a high rate of relative movement. The system is designed such that the hydraulic pressure in those cavities is equal to or greater than the mud pressure.

The seals that are in fluid contact with the drilling fluid are illustrated in FIG. 3, including 90*b*, 90*c*, and 90*e*. The cavities adjacent those seals, that are provided to contain pressurized oil include 66*c*, 66*b* and 66*a*. The pressurized oil is contained in these cavities that are defined by the seals noted above, on one side, and by seals 90*a*, 90*d*, and 90*f* on the opposite side. Thus, cavity 66*c* is defined on one side by seal 90*a*, and on the opposite side by seal 90*b*. These two seals can be the identical part, or they could be different types of seals. In the preferred embodiment the paired seals are identical parts, to reduce the number of different service parts. Seal 90*a* contacts drilling fluid on one side, while it is in contact with pressurized oil in the other side. Seal designs have been developed specifically to optimize seal performance and are described in U.S. Pat. No. 6,382,634 and published application US 2011/0127725 both of which are incorporated by reference. The other two cavities, 66*b* and 66*a* are likewise defined by the seals.

In operation the pressure in the mud can change very unpredictably and quickly. The present system provides a configuration that maintains the hydraulic pressure in the cavity adjacent the seals at a level greater than the mud pressure, even when the mud pressure spikes abruptly.

In the depicted embodiment this pressure intensifier is passive in that it does not rely on an active control system (e.g., measuring the pressure in the mud and controlling valves or pumps to maintain a certain pressure differential). In the depicted embodiment, the system is instantaneous in that an increase in mud pressure causes a direct increase in hydraulic fluid pressure. In the depicted embodiment a pressure intensifier assembly 68 includes a first line 70 in fluid communication with the space 72 that contains mud, and a second line 74 in fluid communication with space 76 that contains hydraulic fluid.

In the depicted embodiment the second line 74 is in fluid communication with a control valve 94 and pump 78 that are used to increase the volume of fluid in the space 45 to extend the inner drive assembly relative to the outer drive assembly during the process of building a drill string or breaking down a drill string. In the depicted embodiment, the passive pressure intensifier assembly 68 is configured to function regardless of whether this active fluid control component is shut off as during typically drilling (e.g., thrusting and rotating of the drill rod), or turned on as when extending or retracting the inner rod drive assembly during make up and break up of a drill string.

The first line 70 is directed to a first portion 72 of the cylinder assembly with a piston face having a first area, and the second line 74 is directed to a second portion 76 of the cylinder assembly having a second area. The first line 70 is also in fluid communication with a mud pump 82, which supplies mud to the drill string via spaces in the drilling mud interface 50. The area of the piston adjacent the first portion 72 is greater than the area of the piston adjacent the second area 76, which results in a greater pressure in the second portion 76 than the first portion 72. The ratio of the first area to the second area of the piston is proportional to the difference in pressure between the two portions of the cylinder assembly. Accordingly, a pressure increase (spike) in the mud in space 54 will result in a corresponding hydraulic pressure increase (spike) in the spaces 66*a*, 66*b* and 66*c*.

In one embodiment the drilling machine includes: a hydraulic drive system; an outer drive shaft driven by the hydraulic drive system, the outer drive shaft configured to rotate an outer drill rod of a drill string, an inner drive shaft driven by the hydraulic drive system, the inner drive shaft configured to rotate an inner drill rod of a drill string, a drilling mud delivery interface unit mounted to the outer drive shaft configured to direct drill mud into the drill string, a seal assembly configured to prevent drilling mud from contaminating hydraulic fluid in the hydraulic drive system, the seal assembly including: a seal 66*a* that includes a mud interface (left surface of the seal) and a pressure compensated interface (right surface of the seal); a hydraulic fluid port 84 extending from the mud delivery interface through a portion of the outer drive shaft to the pressure compensated interface.

In some embodiments the drilling machine further includes a pressure compensator 68 in fluid communication with the hydraulic fluid port 84 configured to control the hydraulic pressure at the pressure compensated interface, wherein the pressure compensator is configured to vary the hydraulic pressure based on the mud pressure and is configured to maintain the hydraulic pressure at a level that is greater than the mud pressure. In some embodiments the pressure compensator comprises a chamber having mud on a first side 72 of a piston 86 and hydraulic fluid on a second side 76 of the piston. Some of these embodiments further include a position sensor that monitors the position of the piston. Also, in some of the embodiments with pistons 86, the pistons include a leak path 88 therein. The leak path is configured to drain any fluid that would otherwise leak past the annular seals on the piston 86.

In the depicted embodiment of the mud delivery interface, the swivel 50 includes two spaced apart radial mud delivery interface seal assemblies, with the first assembly comprising seals 90*a* and 90*b* and the second assembly comprising 90*c* and 90*d*, on either side of a mud delivery port. Each radial mud delivery interface seal assembly includes a mud interface (surface facing the mud) and a pressure compensated interface (surface opposite the mud facing surface). The hydraulic fluid port 84 extending from the mud delivery interface through a portion of the outer drive shaft also provides hydraulic pressure to the pressure compensated interface of the two spaced apart radial mud delivery interface seals.

The present disclosure also provides a method of drilling. In the depicted embodiment the method includes the steps of: employing a hydraulic drive system to drive a dual rod drill string into the ground; employing a mud delivery system to deliver drilling mud down hole through the drill string; providing a first radial seal to block drilling mud from exiting the mud delivery system and a second radial seal adjacent the first radial seal to block hydraulic fluid from exiting the hydraulic drive system; pressurizing a cavity between the first radial seal and the second radial seal to a pressure that is greater than, or equal to, the pressure of the drilling mud.

In some embodiments the step of pressuring the cavity includes providing pressure compensating hydraulic fluid to the cavity. In addition, some methods involve monitoring the flow of pressure compensating hydraulic fluid to determine whether either of the first or second radial seal has failed. The seals are intended to prevent flow, so if flow occurs the seal may have failed. In such embodiments the flow can be monitored by monitoring the position of a piston 86 that interfaces between drill mud and hydraulic fluid, wherein the piston is part of a pressure intensifier 68.

The system described above can be easily and quickly serviced. Seals 90*e* and 90*f* are consistently exposed to a significant speed differential as the speed of the inner rod is significantly higher than the speed of the outer rod. Wherever the boring operation is advancing along a deviated path, the inner rod will be rotated at full speed, while the outer rod will be held in a fixed position, oriented to control the direction of the deviated bore. During this operation the relative rotation seen by seals 90*e* and 90*f* is at the maximum, wherein the wear rate of these seals will likewise be at the maximum, while there will be no relative motion at seals 90*a*, 90*b*, 90*c*, and 90*d*.

Whenever the boring operation is advancing along a straight path, the inner rod will be rotated at full speed, while the outer rod is rotated slowly. During this operation the relative rotation seen at seals 90*e* and 90*f* is less than maximum, but still significant, while the relative rotation at seals 90*a*, 90*b*, 90*c*, and 90*d* is minimal.

Seals 90*a*, 90*b*, 90*c*, and 90*d* will experience the highest relative rotation during the backreaming process wherein the outer rod can be rotated at full speed, as the outer rod is used to transfer power to the backreamer.

As a result of these operating characteristics, seals 90*e* and 90*f* are expected to require the most frequent replacement as they interface between structures that rotate relative to each other (e.g., the head shaft 36 and the seal adapter sleeve 49). Seals 90*e* and 90*f* are also referred to herein as main seals. Seals 90*a*, 90*b*, 90*c* and 90*d* are also expected to require replacement. One of the advantages of the current invention is the accessibility of these seals.

To access seals 90*e* and 90*f*, the adaptor 42 can be removed from the head shaft 36. The replaceable seal adaptor 59 will then be accessible. It can be removed from the inner drive head shaft 46 by unthreading the threaded connection with the seal adaptor sleeve 49. Once the replaceable seal adaptor 59 has been removed, the seals 90*e* and 90*f* can be serviced. The replaceable seal adaptor 59 includes seals on its inner diameter, that have not been described in the previous description. These seal against the inner drive shaft 24 as it slides longitudinally. These seals do not experience any relative rotational movement, and only see sliding movement (axial movement), so they do not experience as significant wear. These seals can, however, be replaced. Once the appropriate parts have been serviced the assembly can conveniently be put back together.

To access the seals 90*a*, 90*b*, 90*c* and 90*d*, the swivel 50 can slide off of the adaptor 42 to expose the seals.

Another aspect of the present invention is useful in its impact on logistics for servicing the machine. The seals 90*a*, 90*b*, 90*c*, 90*d*, 90*e*, and 90*f* are all configured in the illustrated embodiment as identical parts. From the aspect of keeping a supply of repair parts, it is an advantage to utilize the same part for all these different seal locations. It should be appreciated that the main seals 90*e* and 90*f* could be radial seals or seals of another variety, for example, a mechanical face seal could act as a main seal to prevent mud from contaminating the hydraulic fluid.

Referring to FIGS. 5A-7B alternative embodiments are shown. In these embodiments the mud delivery interface (swivel) is shown attached to the inner rod on the up hole side of the outer tube drive motor. In these embodiments the inner rod includes a hydraulic oil port that provides the pressure compensated hydraulic fluids to the seal assemblies. These embodiments are generally similar.

Figure 5A:
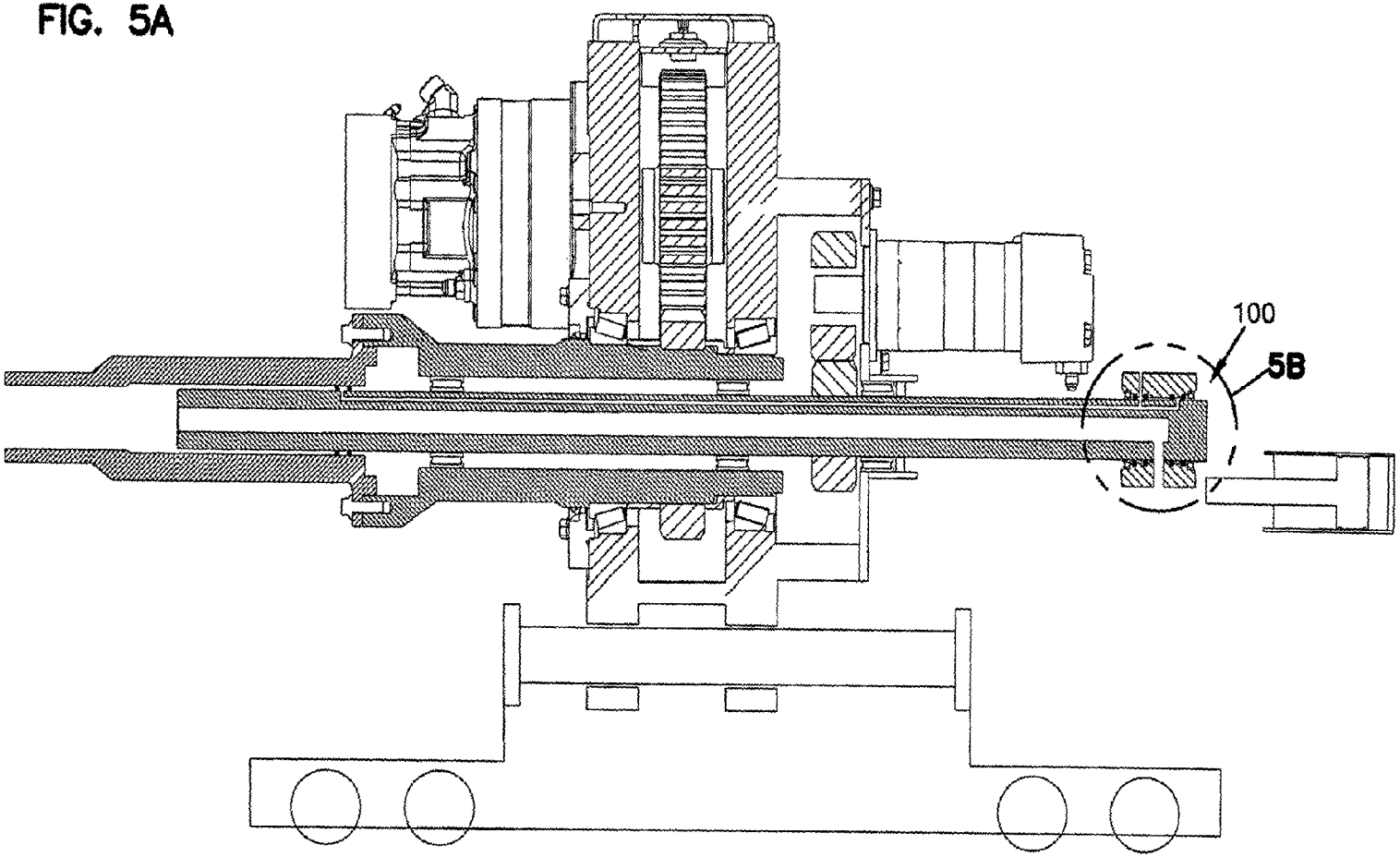
FIG. 5A is a first alternative embodiment of the present disclosure.
Figure 5B:
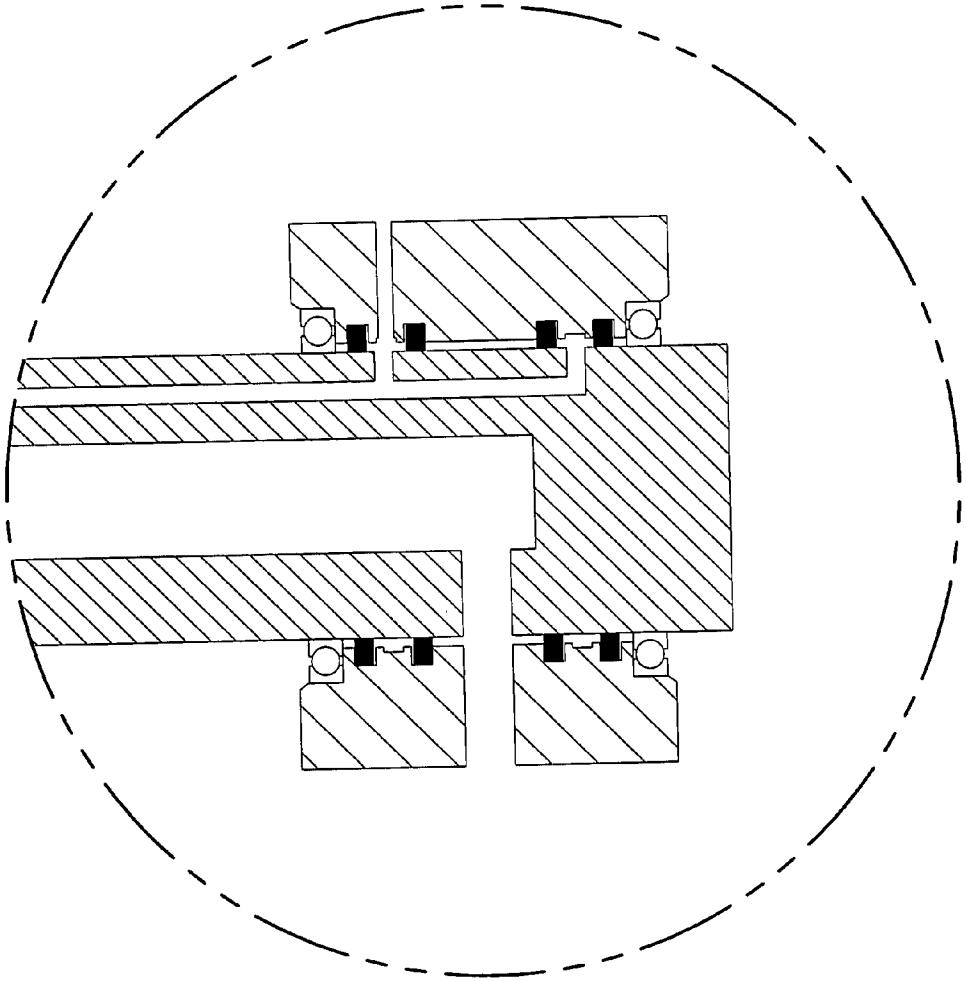
FIG. 5B is an enlarged view of a portion of FIG. 5A.

FIG. 5A shows an embodiment wherein the mud delivery interface 100 is attached around the inner shaft and an oil port end through the inner shaft in the down hole direction.

Figure 6A:
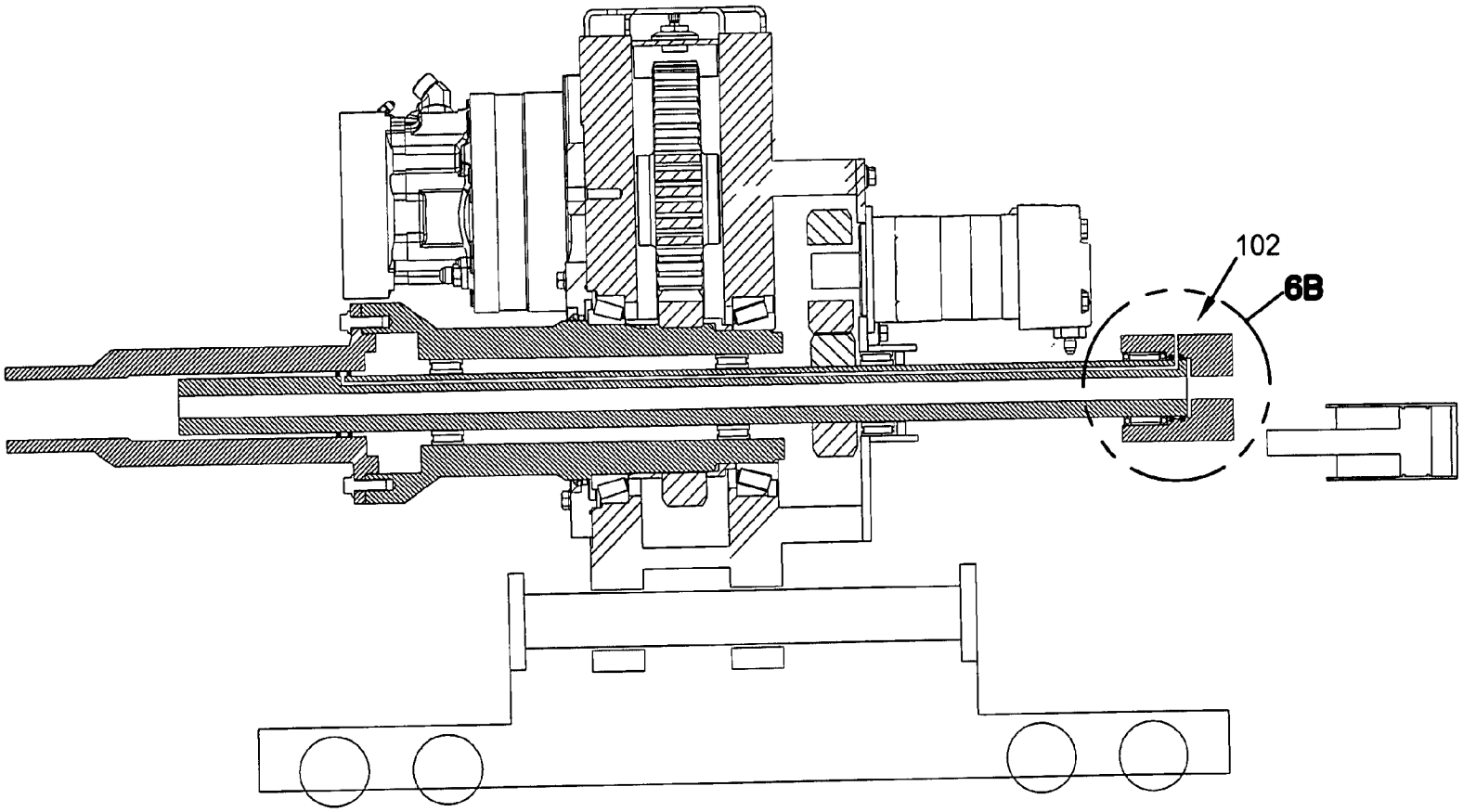
FIG. 6A is a second alternative embodiment of the present disclosure.
Figure 6B:
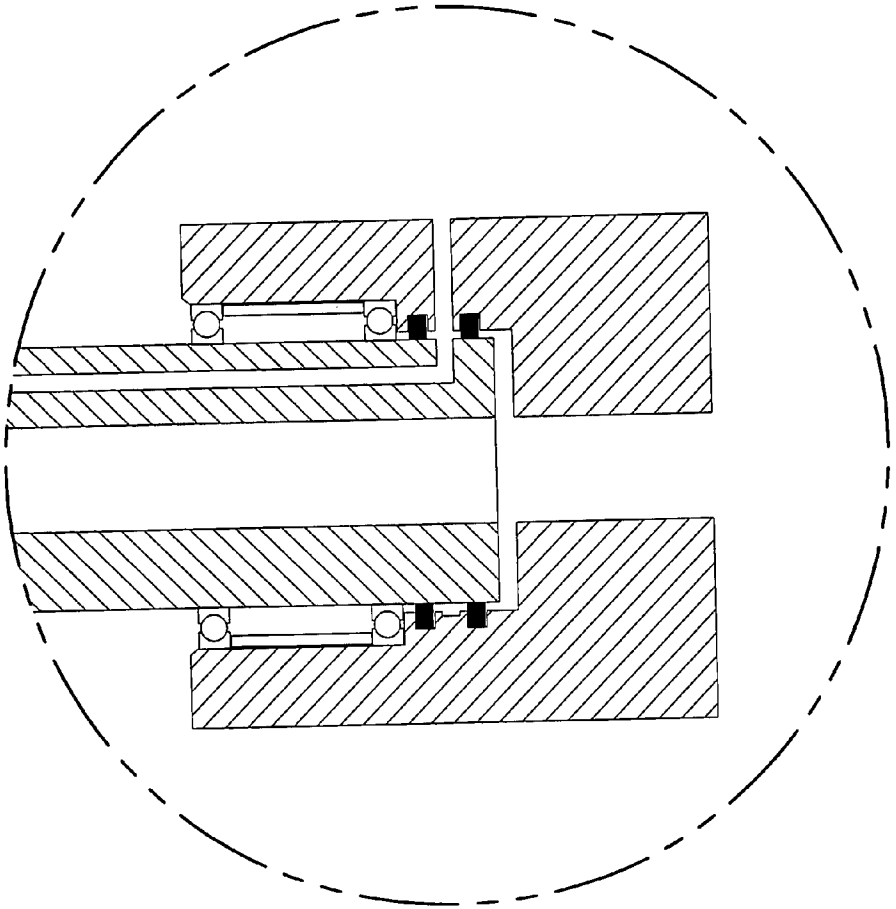
FIG. 6B is an enlarged view of a portion of FIG. 6A.

FIG. 6A is generally similar to FIG. 5A, but it shows an embodiment where the mud delivery interface 102 is attached at the end of the inner drive shaft and includes fewer radial seals than in the embodiment shown in FIG. 2. In the depicted embodiment drilling mud would be delivered axially through the motor that drives the rotation of the inner rod.

Figure 7A:
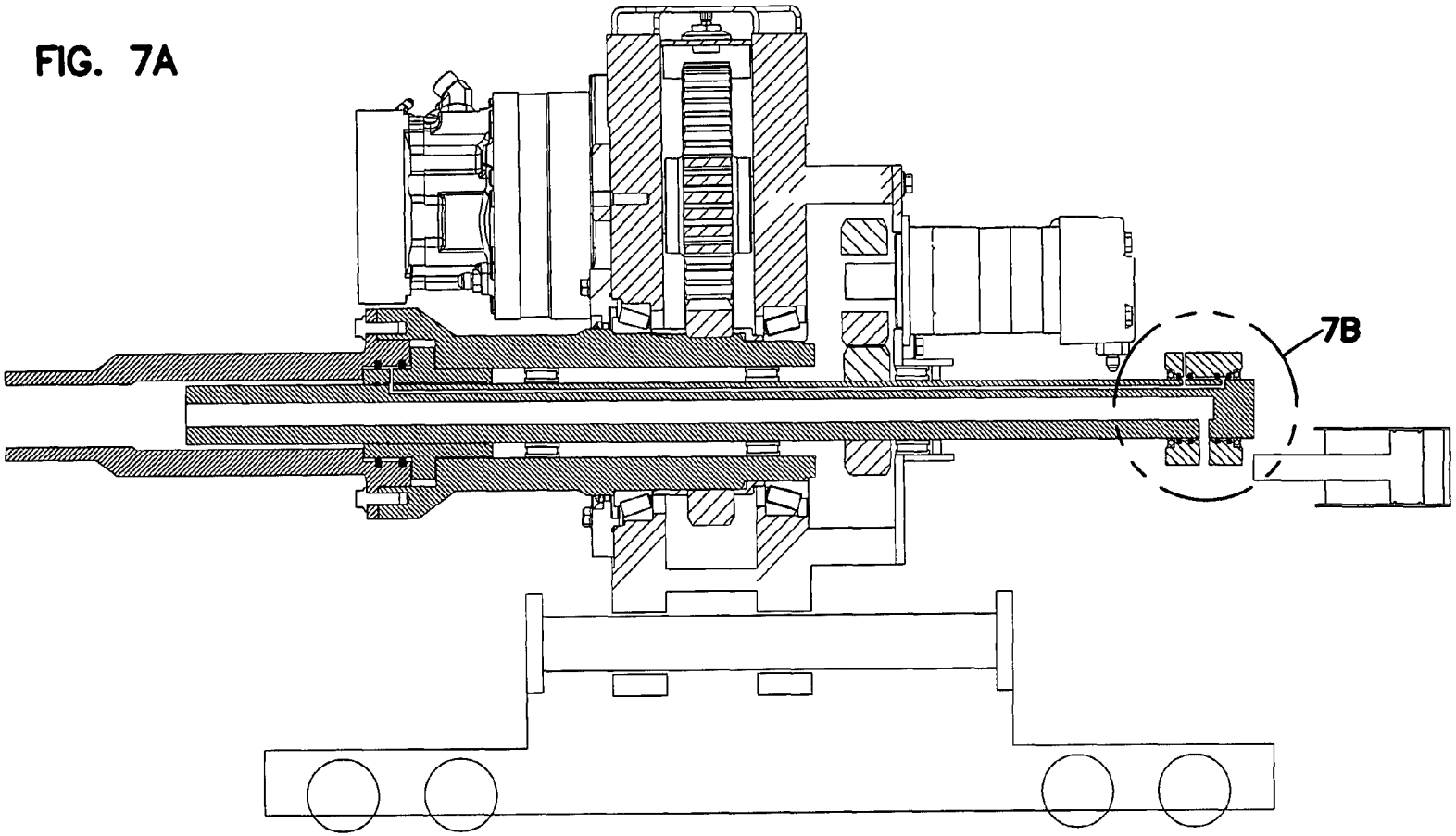
FIG. 7A is a third alternative embodiment of the present disclosure.
Figure 7B:
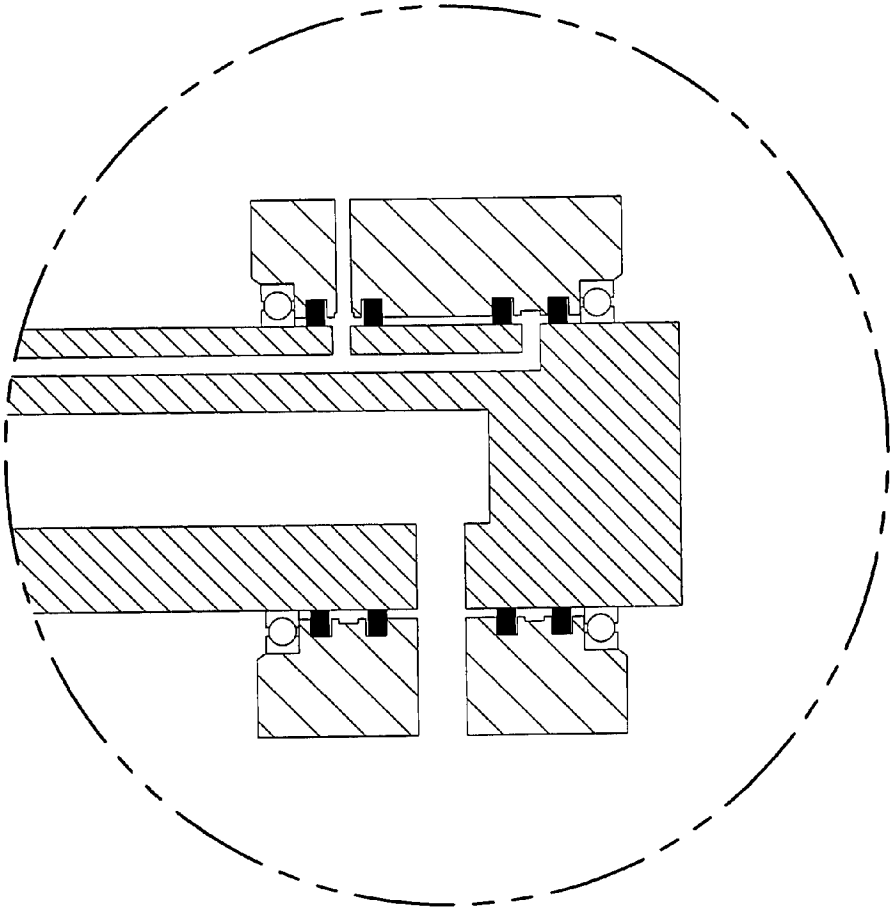
FIG. 7B is an enlarged view of a portion of FIG. 7A.

FIG. 7A shows an embodiment with seals that allow longitudinal movement of the inner rod which are separated from the main seal that only sees rotation. The main seals (similar to seals 90*e* and 90*f* of FIG. 3) seal against a replaceable seal adaptor. In the depicted embodiment the replaceable seal adapter includes: a portion of its inner diameter being non-circular, to mate with a non-circular section outer diameter portion of the inner drive member so that the seal adaptor will rotate with the inner drive member; an inner bore that has grooves to support the seals that see longitudinal movement; and an outer sealing diameter for the main mud seals.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A drilling machine comprising:

a hydraulic drive system;

an outer drive shaft driven by the hydraulic drive system, the outer drive shaft configured to rotate an outer drill rod of a drill string;

an inner drive shaft driven by the hydraulic drive system, the inner drive shaft configured to rotate an inner drill rod of the drill string;

a drilling mud delivery interface unit mounted to the outer drive shaft configured to direct drill mud into the drill string;

a seal assembly configured to prevent drilling mud from contaminating hydraulic fluid in the hydraulic drive system, the seal assembly including:

a first radial seal that includes a mud interface and a pressure compensated interface;

a hydraulic fluid port extending from the mud delivery interface through a portion of the outer drive shaft to the pressure compensated interface; and auxiliary radial seals positioned between the drill mud delivery interface and the outer drive shaft that are configured to prevent mud from exiting the mud delivery interface into the environment outside of the hydraulic drive system, wherein hydraulic fluid from a hydraulic pump is provided to the auxiliary radial seals to provide back pressure opposite the mud interface of the radial seals, and wherein the pressure in the hydraulic fluid provided to the auxiliary radial seals is equal to, or greater than, the pressure in the hydraulic fluid provided to the hydraulic fluid interface of the first radial seal.

2. The drilling machine of claim 1, further comprising a pressure compensator in fluid communication with the hydraulic fluid port configured to control the hydraulic pressure at the pressure compensated interface, wherein the pressure compensator is configured to vary the hydraulic pressure based on the mud pressure and is configured to maintain the hydraulic pressure at a level that is greater than the mud pressure.

3. The drilling machine of claim 2, wherein the pressure compensator comprises a chamber having mud on a first side of a piston and hydraulic fluid on a second side of the piston, wherein the drilling machine further comprising a position sensor that monitors the position of the piston, and wherein the piston includes a leak path therein.

4. The drilling machine of claim 1, wherein the inner drive shaft extends relative to the outer drive shaft.

5. The drilling machine of claim 1, wherein the hydraulic system includes an outer drive shaft hydraulic motor configured to drive the rotation of the outer drive shaft, wherein the drilling mud delivery interface unit is mounted to the outer drive shaft down hole of the outer drive shaft hydraulic motor.

6. A dual rod drill drive assembly comprising:

an outer drive shaft driven by a first hydraulic motor, the outer drive shaft configured to rotate an outer drill rod of a drill string;

an inner drive shaft positioned within a sleeve that is rotated by a second hydraulic motor, wherein the drive shaft is configured to slide axially relative to the sleeve and to rotate with the sleeve;

a hydraulic pump configured to drive hydraulic fluid into the sleeve to extend the inner drive shaft relative to the sleeve;

a drilling mud delivery interface unit mounted to the outer drive shaft configured to direct drill mud into the drill string;

a seal assembly configured to prevent drilling mud delivered via the drilling mud interface from contaminating hydraulic fluid in the hydraulic drive system, the seal assembly including:

a first radial seal that includes a mud interface and a hydraulic fluid interface;

a hydraulic fluid port extending from the mud delivery interface that directs the hydraulic fluid from the pump through a portion of the outer drive shaft to the hydraulic fluid interface; and auxiliary radial seals positioned between the drill mud delivery interface and the outer drive shaft that are configured to prevent mud from exiting the mud delivery interface into the environment outside of the hydraulic drive system, wherein hydraulic fluid from the pump is provided to the auxiliary radial seals to provide back pressure opposite the mud interface of the radial seals, and wherein the pressure in the hydraulic fluid provided to the auxiliary radial seals is equal to, or greater than, the pressure in the hydraulic fluid provided to the hydraulic fluid interface of the first radial seal.

7. The dual rod drive assembly of claim 6, further comprising a pressure intensifier between and in fluid communication with the pump and the mud delivery interface.

8. A drilling machine comprising:

a. a tubular drilling mud delivery interface unit;

b. a drill string driver comprising:

a gearbox;

an outer drive tube;

an inner drive member wherein a portion of the inner drive member is within the outer drive tube;

a main seal assembly between the outer drive tube and the inner drive member;

c. wherein a portion of the drill string driver is within the drilling mud delivery interface unit; the tubular drilling mud delivery interface unit comprising:

a non-rotating outer sleeve with an inlet port for the drilling mud, and an inlet port for pressurized oil;

a first seal assembly that prevents drilling mud from leaking past the non-rotating outer sleeve and the drill string driver wherein the first seal assembly comprises a first seal that separates the drilling mud and the pressurized oil and a second seal that separates the pressurized oil and the ambient environment;

a second seal assembly that prevents drilling mud from leaking past the non-rotating outer sleeve and the drill string driver wherein the second seal assembly comprises a third seal that separates the drilling mud and the pressurized oil and a fourth seal that separates the pressurized oil and the ambient environment;

d. wherein the main seal comprises:

a fifth seal that separates the drilling mud from the pressurized oil;

a sixth seal that separates the pressurized oil and the gearbox;

e. wherein the drill string driver further includes an aperture with an opening between the first and second seals, an opening between the third and fourth seals, and an opening between the fifth and sixth seals.

9. The drilling machine of claim 8 wherein the main seal is longitudinally offset from the drilling mud delivery interface unit, wherein the first, second, third, fourth, fifth and sixth seals are the same.

10. The drilling machine of claim 8, wherein the non-rotating outer sleeve is mounted to the inner drive member up hole of the gearbox.

11. The drilling machine of claim 8, wherein the inner drive member includes a mud port therein.

12. The drilling machine of claim 8, wherein the space between the fifth seal and sixth seal includes oil at a controlled pressure, wherein the controlled pressure is based on the mud pressure.

13. The drilling machine of claim 8, wherein the inner drive member includes an oil port that extends from the non-rotating outer sleeve to the space between the fifth and sixth seals.

* * * * *